United States Patent [19]

Fuchs

[11] 3,981,695

[45] Sept. 21, 1976

[54] ELECTRONIC DUST SEPARATOR SYSTEM

[76] Inventor: Heinrich Fuchs, Haus 88, 8601 Steinfeld, Germany

[22] Filed: Nov. 2, 1973

[21] Appl. No.: 412,185

[30] Foreign Application Priority Data

Nov. 2, 1972 Germany ..... 2253601
Aug. 11, 1973 Germany ..... 2340716

[52] U.S. Cl. ..... 55/138; 55/2; 55/139; 55/152; 55/154; 317/3; 317/146

[51] Int. Cl.[2] ..... B03C 3/00

[58] Field of Search ..... 55/2, 138, 105, 152, 55/139, 154; 317/146, 3

[56] References Cited

UNITED STATES PATENTS

| | | | |
|---|---|---|---|
| 2,000,020 | 5/1935 | Heinrich | 55/2 |
| 2,509,548 | 5/1950 | White | 55/139 |
| 2,782,867 | 2/1957 | Hall | 55/139 |

FOREIGN PATENTS OR APPLICATIONS

| | | | |
|---|---|---|---|
| 248,429 | 10/1963 | Austria | 55/105 |
| 1,031,947 | 6/1966 | United Kingdom | 55/105 |

*Primary Examiner*—Bernard Nozick
*Attorney, Agent, or Firm*—Hill, Gross, Simpson, Van Santen, Steadman, Chiara & Simpson

[57] ABSTRACT

A device for electronic collection of dust which includes an electrostatic separator and a high voltage transformer which, in conjunction with a pulse generator, supplies a pulse voltage to the separator. The output voltage of the pulse generator is superimposed on the output voltage of the transformer to cause the voltage at the electrostatic separator to exceed the spark over limit, once each cycle of the transformer output.

26 Claims, 19 Drawing Figures

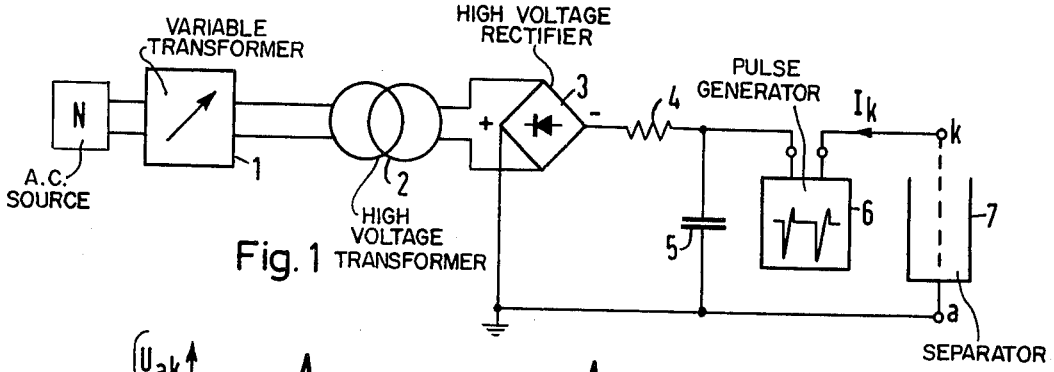
Fig. 1
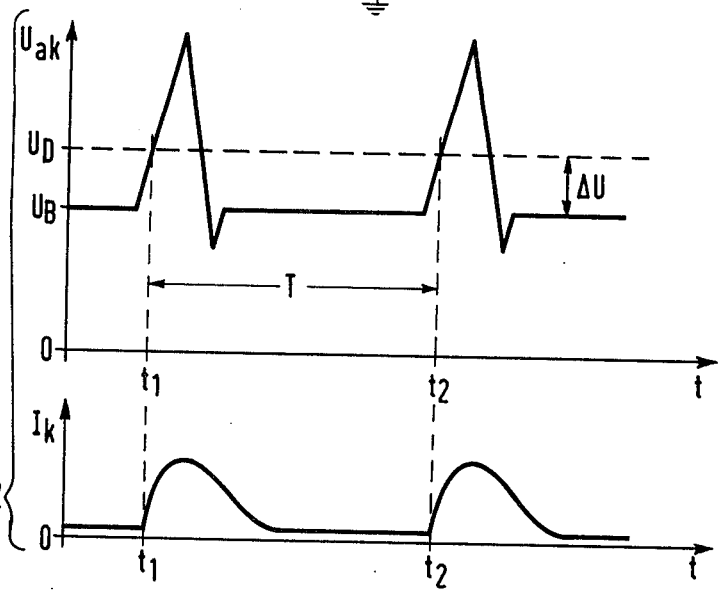
Fig. 2
Fig. 3
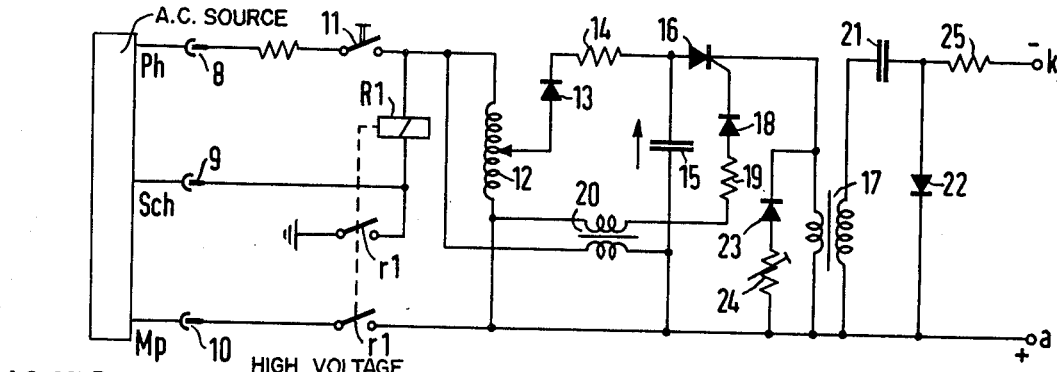
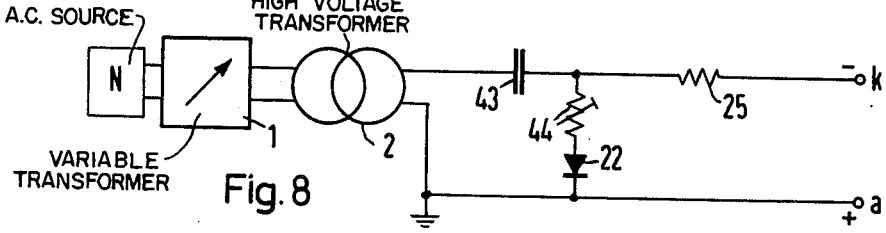
Fig. 8

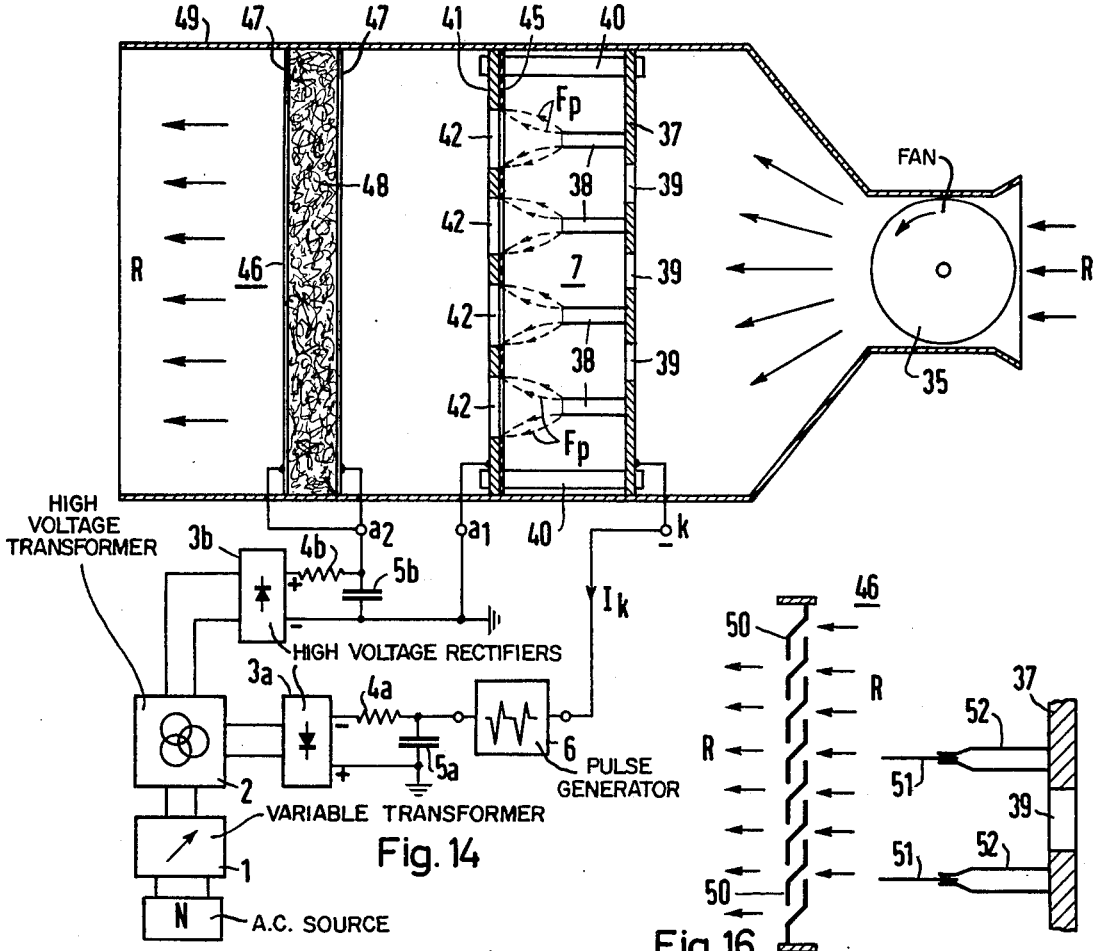
Fig. 14
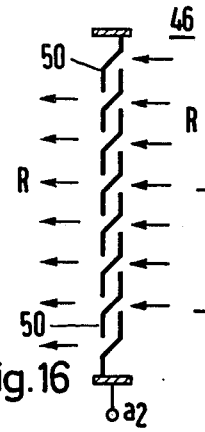
Fig. 16
Fig. 17
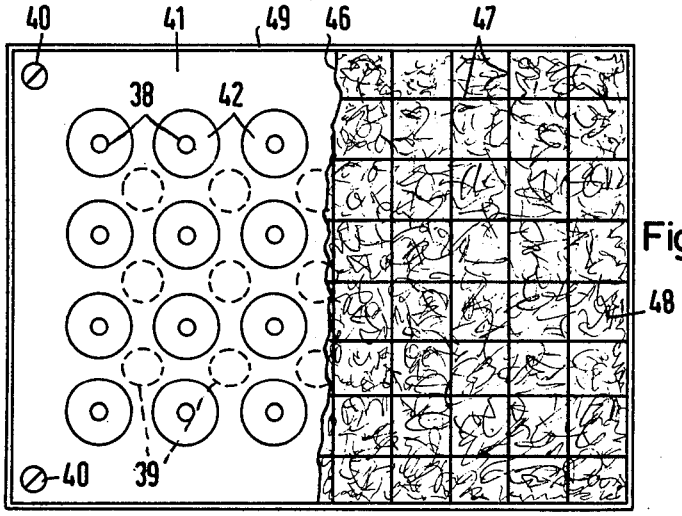
Fig. 15
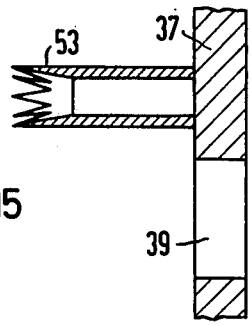
Fig. 18
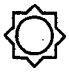
Fig. 19

ELECTRONIC DUST SEPARATOR SYSTEM

SUMMARY OF THE INVENTION

It is an important feature of the present invention to provide an improved electronic dust collection system.

It is another feature of the present invention to provide a dust collection system which avoids spark over while maintaining maximum dust collection capability.

It is an object of the present invention to provide a dust collection device as described above wherein a transformer and a pulse generator are arranged to produce a voltage at the electrostatic separator which exceeds the spark over limit for a short interval only, thereby preventing spark over.

It is another feature of the present invention to provide a device as described above wherein a charging and discharging circuit is connected to the high voltage transformer and caused to discharge suddenly through the high voltage transformer to produce the desired voltage at the electrostatic separator.

Another object of the present invention is to provide an improved degerming device.

These and other objects, features and advantages of the present invention will be understood in greater detail from the following description and the associated drawings, wherein reference numerals are utilized to designate a preferred embodiment.

BRIEF DESCRIPTION OF THE DRAWINGS

FIG. 1 is a block diagram indicating the apparatus of the present invention.

FIG. 2 indicates the waveform of the voltage between the anode and cathode of the apparatus of FIG. 1.

FIG. 3 shows a specific embodiment of the invention, showing the details in schematic form.

FIG. 8 shows an alternative embodiment of the invention.

FIG. 14 illustrates an overall layout for an apparatus used to remove bacteria from the air.

FIG. 15 shows a view of the outlet side of the airshaft shown in FIG. 14.

FIG. 16 shows a space-saving configuration of an absorber anode.

FIG. 17 shows a constructional arrangement showing electrode ends shaped like needles.

FIG. 18 shows a modified arrangment of the device of FIG. 17.

FIG. 19 shows a top view of the device shown in FIG. 18.

DESCRIPTION OF THE PREFERRED EMBODIMENT

Figure 4:
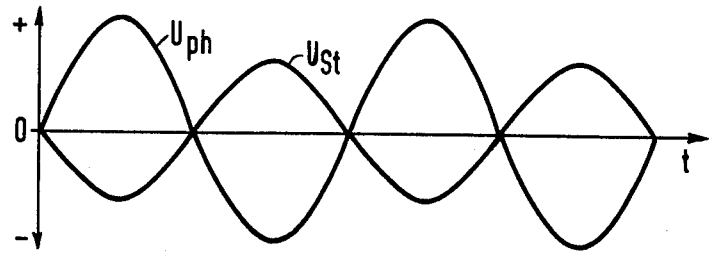
FIGS. 4 through 7 shows voltage waveforms associated with FIG. 3.

The submitted invention is concerned with a procedure for the electronic collection of dust by means of an electric separator to which a high voltage is applied. As is generally known, an electric separator reaches its maximum degree of dust removal when operated with a voltage just below the flash-over limit. However, since the occurrence of flash-overs caused by irregularities of the ionization conditions between the anode and cathode of the electric separator cannot be avoided during operation, all presently known separators are equipped with rather sophisticated control and servo mechanisms in order to reduce the operating voltage quickly after a flash-over or an arc and to restore it to its original level after quenching of the arc. For example, the German No. 1 074 012 describes a procedure for the automatic control of the current intensity of an electric separator, according to which the separator is after a flash-over for a short period deenergized by means of an overload relay to be subsequently re-energized while interconnecting a current limiting resistor. Latter resistor is disconnected when the disturbance is passed and a servo motor has restored the high voltage to its original level. This leads to a certain cutdown in voltage restoration time; for the implementation of this procedure, however, relatively complicated and time-consuming actuating mechanisms are required.

This invention is intended to increase the degree of dust collection to surpass the limitations of presently known electric separators by considerably simpler methods. The inventor solves this problem by regularly changing the voltage of the electric separator from an operating value below the flash-over limit to one above this limit for short periods. Thus, the basic idea of the invention is to exceed the flash-over or sparking voltage intentionally under normal service conditions, without waiting for flash-over, reducing the voltage of the electric separator in good time. This idea utilizes the effect of the so-called "discharge delay", according to which the flash-over after application of an electrode voltage higher than the flash-over voltage will happen with precisely estimable time delay.

It is most practical to select for this pulse-type peaking of the electric separator voltage an average time value below the flash-over limit. This will result in a high degree of dust extraction an ensure increased dielectric strength.

The average time value may be selected very close to the flash-over limit, in which case the electric separator voltage after each peak will be reduced below the operating level, preferably to zero - another characteristic of this invention which will result in extremely high percentages of dust collection.

The invention and elaborations thereof, further identified in the sub-claims, will be explained in detail in the following text with reference to the attached drawings.

FIG. 1 represents a block diagram indicating the apparatus required for the realization of the invention. The primary of a manually operated variable transformer (1) is connected to an a.c. power supply N, while its secondary is tied to the primary windings of a high voltage transformer (2).

The secondary of the high voltage transformer (2) is connected to the a.c. terminals of a high voltage rectifier (3) consisting of four bridge-connected non-driven semiconductor diodes. The output of the high-voltage rectifier (3) is smoothed by means of an RC network (4, 5) and connected, in series with the output voltage of a pulse generator (6), to the electrodes of an electric separator (7). The cathode of the separator is identified by the letter k, the anode by a.

If the high-voltage transformer (2) is a three-phase device and the high-voltage rectifier is a three-phase bridge circuit, the smoothing circuit is dispensable. The pulse generator (6) furnishes periodic pulses, for instance with the frequency of the a.c. power source, so that, for a short period of time, the electric separator voltage is brought to a level above the flash-over voltage.

FIG. 2 indicates the waveform of the voltage Uak between the anode and cathode of the apparatus shown in FIG. 1. The operating value of the electric separator voltage $U_B$ is the flash-over voltage $U_D$ reduced by a certain safety margin Δ U. This corresponds to the smoothed output of high-voltage rectifier (3). The flash-over limit $U_D$ will for a short period be exceeded at the instants t1 and t2 which, for example, are spaced in time in accordance with the period T of the power supply frequency. This surpassing of the flash-over limit is due to superpositioning the output of the high-voltage rectifier (3) and the output voltage of the pulse generator (6). As may be seen from the lower part of FIG. 2, this results in increased separator current Ik. The extent of the safety margin as well as pulse height and length, that is the pulse-time area of the pulses furnished by the generator, may be so matched to each other that spark discharge is absolutely prevented. It is evident that according to the typical current-voltage characteristic of a spark gap, a continuous current equivalent to the mean d.c. value of the separator current $I_K$ would have to be associated to a separator voltage which would permanently lie above the flash-over limit $U_D$, while the mean value with respect to time of the effective separator voltage $U_{ak}$ is below the flash-over limit as indicated in FIG. 2. This results from the non-linearity of this current-voltage characteristic.

FIG. 3 shows a particularly simple version of an apparatus for the generation of the electric separator voltage according the the inventor's ideas. This apparatus is especially suitable for portable equipment. The input leads 8, 9 and 10 represent the pins of a mains plug. When lead 8 is connected to a phase Ph of the mains, lead 9 to a protective conductor Sch (non-fused earthed conductor according to German safety regulations) and lead 10 to the neutral (center) or zero conductor of the mains, Mp, the coil of test relay R1 is energized on actuation of switch 11. This will apply the mains voltage through one contact r1 of this relay to variable transformer 12, while the other relay contact r1 connects the protective conductor to the enclosure. In case the mains plug were to be inserted into the outlet with any other polarity, relay R1 would not pick up when switch 11 is actuated, thus eliminating the possibility of the circuit to become operative.

The positive alternation of an a.c. voltage, the amplitude of which is adjustable by variable transformer 12, is sent via diode 13 and resistor 14 to charging capacitor 15 which is thereby charged to its peak value. During the next alternation of this a.c. voltage capacitor 15 is suddenly discharged through thyristor 16 and the primary of high-voltage transformer 17. The gate circuit of thyristor 16 consists of diode 18 and current limiting resistor 19 and is energized by the voltage of the secondary of transformer 20. The primary of this transformer is also connected to the phase voltage; its secondary, however, furnishes a gate voltage shifted in phase 180° in relation to the voltage of transformer 12. During the pulse-type discharge of capacitor 15, diode 22, which is connected in series with capacitor 21 in the secondary circuit of transformer 17, is driven in reverse direction and the potential at cathode terminal

*k* is raised by the value of the stepped-up discharge pulse. For the subsequent fly-back pulse ("post-shoot"), however, diode 22 is driven in forward direction. The pulse charges capacitor 21 building up a negative d.c. voltage across it. The voltage level may be adjusted by means of an attenuator circuit, connected in parallel with the primary of high-voltage transformer 17, and comprising diode 23 and variable resistor 24. Cathode terminal *k* is connected through protective resistor 25 to the junction capacitor 21, diode 22. Since the spark gap is always supplied by the accurately-known energy content of capacitor 21, this circuit is absolutely short-circuit proof and protected against arc discharge.

Figure 5:
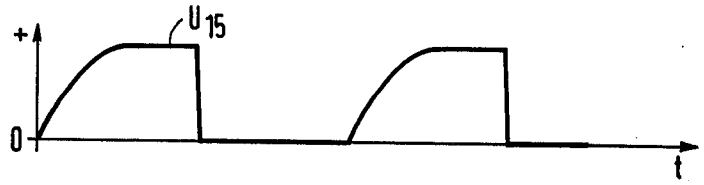
Figure 6:
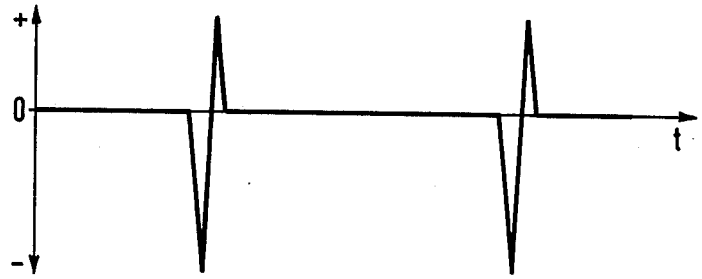
Figure 7:
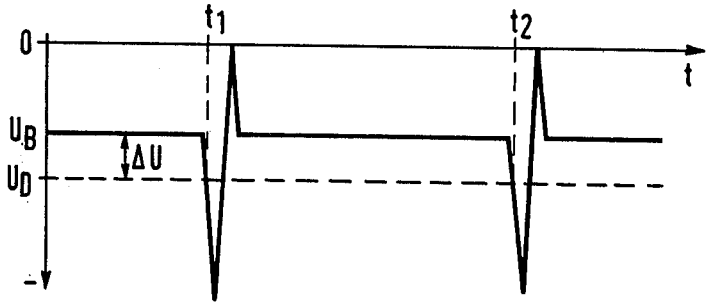

FIGS. 4 to 7 show the voltage waveforms for the circuit represented by FIG. 3. First of all, FIG. 4 indicates the phase voltage Uph between phase conductor Ph and the neutral or zero conductor Mp, also the gate voltage $U_{St}$ for thyristor 16 which is out of phase 180° in relation to the aforementioned voltage and is the secondary voltage of transformer 30. FIG. 5 displays the voltage U15 across charging capacitor 15 which rises exponentially during the positive alternation of phase voltage Uph towards its peak value and which, after the appearance of gate voltage $U_{St}$ due to the firing of thyratron 16, suddenly drops to zero. FIG. 6 points out the secondary voltage of high-voltage transformer 17. The figure depicts the negative voltage pulse appearing during the discharge of capacitor 15, followed by a positive fly-back pulse ("post-shoot") that charges capacitor 21. Finally, FIG. 7 shows the waveform of the cathode potential with reference to cathode terminal *a* which is connected to zero or neutral wire Mp. This waveform is basically similar to the voltage diagram indicated in FIG. 2 except that the voltage between anode and cathode is, in effect, lowered towards zero value, enabling an even smaller safety margin Δ U with relation to the flash-over voltage Ud to be selected.

FIG. 8 represents an alternative set-up for the pulse-type peaking (voltage peaking) in which, as in FIG. 3, high-voltage rectifier and pulse generator are effectively combined to a single circuit; this set-up is also characterized by the advantage of being short-circuit and arc-discharge proof. This set-up appears to be particularly well suited for large-scale dust removal installations. It consists basically of the familiar voltage doubler circuit with high-voltage transformer 2, the secondary of which is grounded and also connected to the series circuit comprising voltage doubling capacitor 43, adjustable resistor 44 and a half-wave rectifier, diode 22. The plate of doubler capacitor 43 not connected to the secondary winding may be tied to cathode *k* via protective resistor 25 in order to limit the discharge current of the capacitor. Feeding the high-voltage transformer with a single-phase a.c. voltage will give basically the same waveforms as indicated in FIG. 2. The pulse height may be adjusted by changing the output voltage of power transformer 1, while resistor 44 serves to adjust the operating voltage $U_B$ which provides the pre-ionization.

Figure 9:
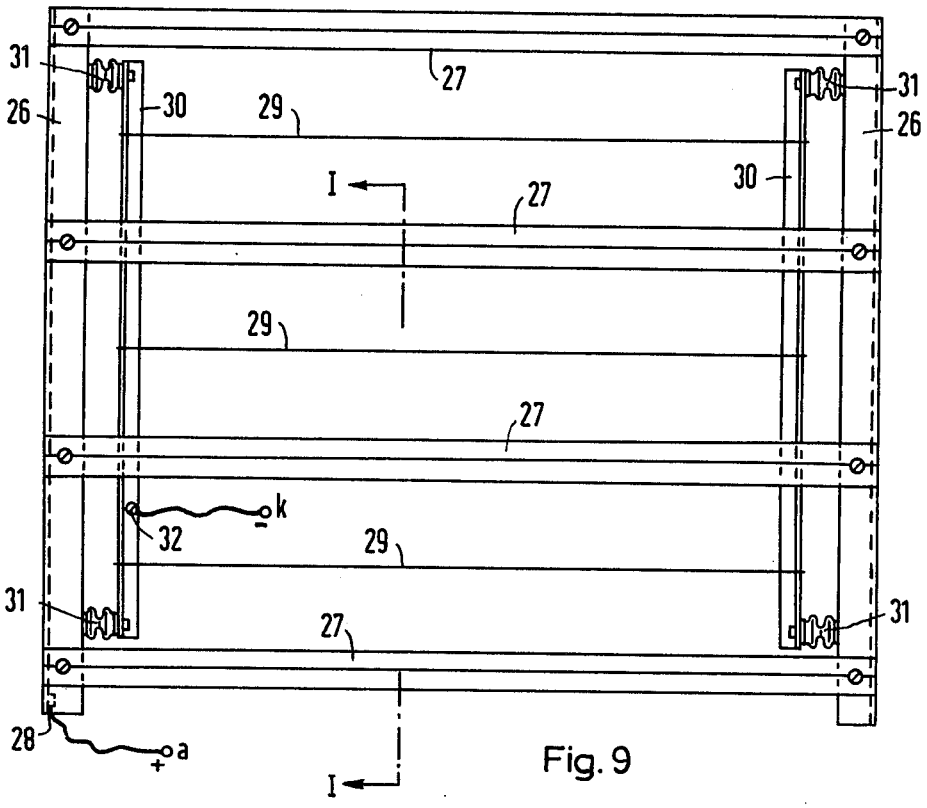
FIG. 9 shows one embodiment for the mechanical features of the electric separator.

FIG. 9 shows one possible design for the electric separator, utilizing the excellent advantages offered by the pulsed peaking of the electric separator voltage to free the air from germs and microorganisms. Rod-type anodes 27, horizontal and parallel to each other, are fastened to two angle brackets 26. These anodes are electrically connected to anode terminal *a* by means of connecting screw 28. The anodes 27 consist of angle section with equal legs. Cathode electrodes 29 are arranged halfway between, parallel to and behind each such pair of anodes. The narrow sides of the ribbon-shaped cathodes face the anodes. The cathode electrodes 29 are fastened by two angle irons 30 which in turn are fixed by ceramic insulators 31 to angle iron brackets 26. By means of a further connecting screw 32, the cathode electrodes are connected to cathode terminal *k* via a lead.

Figure 10:
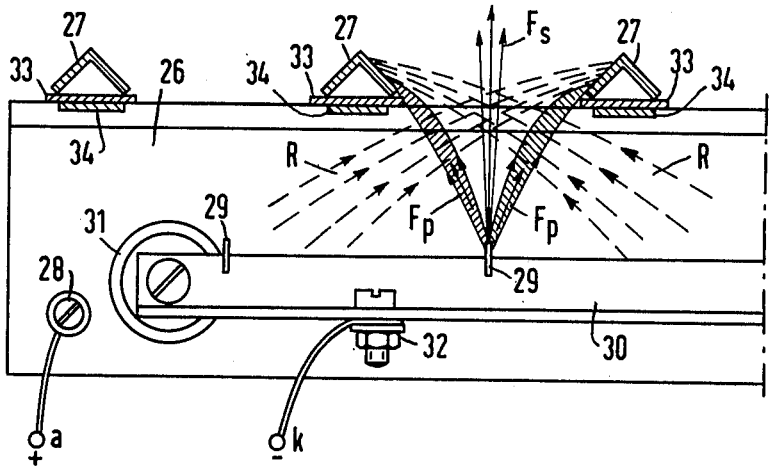
FIG. 10 is a slightly enlarged view of the section identified by I—I in FIG. 9.

FIG. 10 shows a slightly enlarged view of the section identified by I—I in FIG. 9. It may be seen that the ribbon-shaped cathode electrodes 29, the narrow sides of which are knife-edge shaped to attain a high field strength, are arranged in the plane of symmetry of two adjacent anode electrodes and located behind them. The ends of the legs of angle sections 27 are each interconnected by a continuous plastic insulating strip 33. These strips are utilized for shielding the cathode electrodes and may be considered as focusing electrodes. For the purpose of the invention, strips of fiber glass-reinforced polyester have proven particularly efficient. Furthermore it was found that the developing charge carrier current between the anodes and cathodes could be considerably better focused by providing the side of strips 33 facing the cathode electrodes 29, except for a narrow edge, with a metal layer 34.

The operating value $U_B$ of the voltage applied between terminals *a* and *k* is selected sufficiently large to provoque an independent "cold" discharge (brush discharge) caused by the freeing of electrons at the cathode and by ionization by collision. As a consequence of the shape of the electrodes, as indicated in the sketch, a relatively sharply focused flux negative charge carriers, $F_P$, results between the cathodes and anodes. This flux extends principally along the connecting plane between the cathode and anode electrodes which are associated to each other. However, some of the charge carriers liberated from the cathode and accelerated by the anode electrodes, will always be ejected through the anodes into the clear space, mostly along the plane of symmetry of two adjacent anode electrodes. This flux of electrons or ions, $F_S$, which could be termed as an ionic wind, will result in negative charging of the air of the room. It is possible to strengthen the ionic wind considerably by the raising of the electric separator voltage in pulses to above the flash-over value. There will be a noteworthy underpressure in the wedge-shaped spaces formed by the two charge-carrier fluxes $F_P$ emitted by the same cathode. The underpressure will cause a sucking-in of ambient air. The resulting ambient air flow R passes through charge carrier flux $F_P$ and is thereby negatively charged. The negatively charged particles of ambient air flow R then collect on the anode electrodes. It has been proven that bacterial dust is thus intercepted by the anode electrodes, the air being thereby effectively decontaminated, and that this dust has also been made absolutely non-virulent, that is biologically inert.

Figure 11:
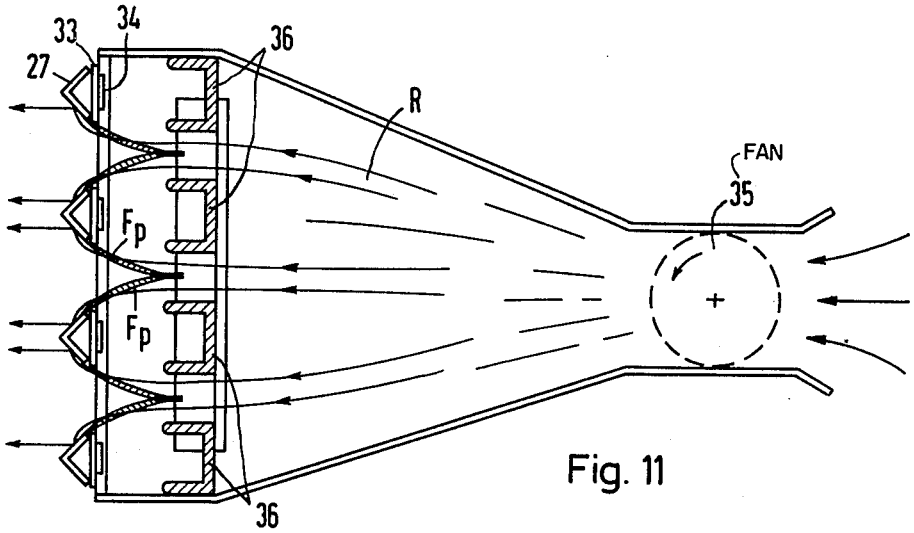
FIG. 11 shows an embodiment of the invention using a fan located behind the cathode of the separator.

For medical applications in which the endurance limit of human beings might be exceeded due to ozone formation inherent in the generation of ionic wind $F_S$ which is caused by the short-term peaking of the electric separator voltage, it would be reasonable to diminish the pulse amplitude of the electric separator voltage and to provide by other means for an adequate flow of ambient air through the area of charge carrier flux $F_P$. In the arrangement represented in FIG. 11 this would be achieved by fan (blower) 35 located behind the cathode electrodes 29. U-shaped sectional metal bars are arranged on either side of each cathode electrode in such a manner that air intake and outlet holes are located only in the region of the knife-edge shaped electrodes 29 and that each cathode electrode is associated with two parallel supplementary electrodes, these being the legs of the sectional bars 36 and having the same potential as the cathode electrodes. The radius of curvature of these supplementary electrodes is considerably larger than that of the blades of the cathode electrodes. Therefore, the supplementary electrodes do not emit any electrons, but serve only to enhance the focusing of the primary charge carrier flux $F_P$ (see FIG. 10). Of course such supplementary electrodes may be used with the same advantages for the version indicated in FIG. 6. It should be noted that the velocity of the wind caused by the fan must not be too high; it should stay in the order of magnitude of the migration speed of the charge carriers. As in the set-up shown in FIG. 10, ambient air R will be forced to cross through the flux of primary charge carriers $R_P$, with subsequent collection of the negatively charged dust particles at the anode.

Figure 12:
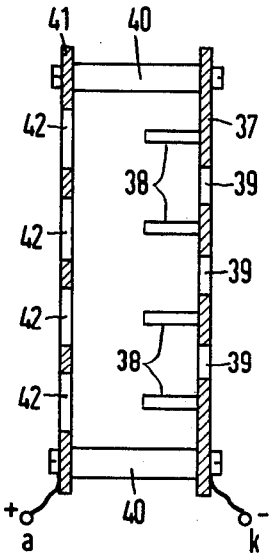
FIGS. 12 and 13 shows an alternative arrangement of the invention where there are knife-edge shaped ends of pipes fastened to metal plates as electrodes.
Figure 13:
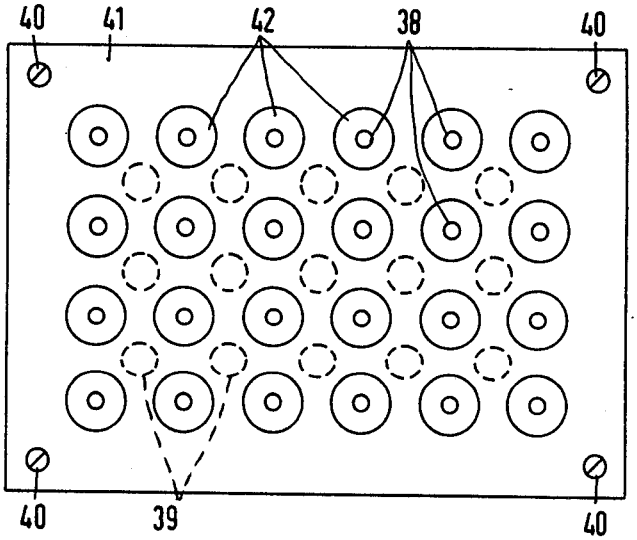

The cathode electrodes of the alternative set-up depicted in FIG. 12 and 13 are the knife-edge shaped ends of pipes 38 fastened to metal plate 37. Circular bores 39 in plate 37 are interspersed between the individual pipes. Plate 37 is connected to a further plate, 41, by means of four spacers 40 made of highly insulating plastic, and eight machine screws. The latter plate serves as anode. It is also provided with circular bores 42 concentric with the pipes 38. The zones of charge carrier flux building up between the anodes and cathodes - marked $F_P$ in FIG. 10 - are in this case, not wedge- but funnel shaped. Apart from this variation, all further elaborations of the alternative set-up described by the FIGS. 9 to 11, e. g. the insulating strips, their metal coating, the supplementary electrodes and the fan, may be utilized accordingly, this eliminating repeated graphic presentation. In comparison with the ionic wind generator dealt with in FIGS. 9 and 10, the one illustrated in FIG. 12 and 13 has the advantages of extreme compactness and ability to be adapted in its spatial shape to any given requirements.

When the versions so far described are used, a residual ionization of the air passing through the electric separator, and consequently the generation of ozone, can never be avoided completely. It may be reduced by decreasing the voltage of the pulse amplitude though it cannot entirely be suppressed. Since the decrease of the pulse voltage amplitude will diminish the effectiveness of the separator, this will give rise to limitations particularly in medical use and degrade the efficiency of such an apparatus.

In order to eliminate the effects of ionization and ozone formation on the surroundings, the ions may be absorbed by an additional anode operating at a higher positive potential and arranged behind the anode opposite to the cathode. The additional anode is provided with holes for air intake and outlet. This absorbing anode acts as an ion filter and thus permits a considerably higher ionization of the air in front of this anode. Thus, the effectiveness of the electric separator will be markedly increased.

FIG. 14 illustrates the overall layout of an apparatus for the removal of bacteria from the air, as improved by the above mentioned features. Since it corresponds basically to the arrangements shown in FIGS. 1 and 12, the same reference designations for equivalent components were retained. The output of high-voltage rectifier 3*a* is smoothed by RC circuit 4*a* and 5*a* and applied in series with the output voltage of pulse generator 6 to the electrodes of electric separator 7. Again, terminal *k* is associated to the cathode, terminal *a*1 to the anode of this electric separator.

While the smoothed output of high-voltage rectifier 3*a* always remains below the value decisive for flash-over between the electrodes of electric separator 7, the superposition of the voltage from pulse generator 6 causes the resulting voltage between the electrodes to surpass the flash-over limit periodically and momentarily.

High-voltage transformer 2 is equipped with a further secondary winding, to which another high-voltage rectifier, 3*b*, is connected, the d.c. output of which is smoothed by RC-network 4*b*, 5*b* as described previously. The smoothed output is applied to terminal *a*2 of a further anode, 8, in such a manner, that the potential in positive direction is higher than that of terminal *a*1. It would be useful to rate the potential differences between terminals *a*2 and *a*1 and between terminals *al* and *k* in such a manner as to be as nearly equal as possible. In order to attain a sharply focused charge carrier flux $F_P$, anode plate 41 is provided with plastic layer 45 on the side facing the cathode. Electrons hitting this layer build up a negative surface charge which diffracts the charge carrier flux towards the bore holes 42. The efficiency is thus increased considerably.

The second anode, 46, called absorber anode, is composed of the wire gratings 47, between which steel wool 48 is porously packed in such a manner as to prevent a straight passage of the air. Second anode 46 as well as electric separator 7 are fitted flush into shaft 49 made of highly insulating plastic and provided with forced draft ventilation by fan 35.

The set-up described above functions as follows: Fan 35 will force into air shaft 49 ambient air R which is compelled to pass through the negative charge carrier fluxes $F_P$, thereby acquiring negative charge. The bulk of the thus ionized air precipitates on anode plate 41. The remaining air together with the charge carriers, which are liberated from the cathode and have passed through the anode openings 42, that is the ionic wind, hit absorbing anode 46 where they are neutralized, so that the flow of air behind anode 46 is absolutely free of ions. Due to the ability of anode 46 to absorb ions, the rate of air flow caused by the fan may be selected relatively high.

A view of the outlet side of air shaft 49 is given in FIG. 15. It shows in section wire grating partition 47 facing the outlet side, steel wool packing 48 and, behind the packing, anode plate 41 of electric separator 7.

FIG. 16 represents a further space-saving configuration of absorber anode 46 consisting of a number of Z-shaped metal strips 50 in parallel arrangement. The strips partially overlap each other in a louver-type arrangement to prevent a straight-line passage of air as in the set-up represented by FIG. 14. Thus the negatively charged particles are forced to strike one of the metal strips 50 where they are neutralized, rendering the air flow behind absorber anode 46 electrically neutral.

Since the degree of ionization of the air ahead of the anode, due to the ion trap formed by absorber anode 46, may be selected as high as desired, it is reasonable to effect this increase not only by a corresponding raising of the voltage between the electrodes of the electric separator, but also by an appropriate shaping of the cathodes facing the anode plate 41. For any given electrode voltage, the effective field strength and thus the degree of ionization of the air will be in inverse relation to the radius of curvature of the cathode electrodes; therefore it is of value to make the openings at the ends of the cathode electrodes facing anode 41 as point-shaped as possible.

FIG. 17 shows a constructional example therefor. The ends of the cathode electrodes are shaped like needles 51 and connected to metal plate 37 via bracket 52. Otherwise the arrangement of the cathode electrodes on metal plate 37 corresponds to the set-up represented by FIG. 14. Since in this design, FIG. 17, the ends of the cathode electrodes are effectively point-shaped, the efficiency of the electric separator will be improved to a great extent.

The modification displayed in FIG. 18 offers a further improvement over the above mentioned features. Whilst the arrangement shown in FIG. 17 is provided with a single point-shaped electrode only, the configuration depicted by FIG. 18 possesses a cluster of these point-shaped electrodes, thereby multiplying efficiency compared to the set-up in FIG. 17. The individual cathode electrodes consist of pipes 53, the cross section of which is star-shaped as illustrated by the top view, FIG. 19. Their ends are provided with an inside taper which gives the toothed rim shown in the sketch. The manufacture of the latter version would be a very simple process.

I claim:

1. A device for the electronic collection of dust comprising:

an electrostatic separator including an anode and a cathode, a high voltage transformer including a primary winding and a secondary winding, means for supplying an input voltage to said primary winding, a pulse generator connected in circuit with said transformer for supplying a pulse to said electrostatic separator, the output voltage of said transformer being close to and below the spark over limit of said electrostatic separator, said pulse generator voltage being superimposed on the output of said transformer to cause the voltage to exceed the spark over limit within one of the half cycles of each cycle of said transformer output voltage, and a serial electrical path including a capacitor and a diode connected across said secondary winding of said transformer and connected to and supplying voltage across said electrostatic separator anode and cathode.

2. A device in accordance with claim 1, comprising a protective resistor connected between said capacitor and said cathode of said electrostatic separator.

3. A device in accordance with claim 1, comprising an attenuating resistor and a further diode connected together in series and in parallel with said primary winding of said high voltage transformer.

4. A device in accordance with claim 1, wherein said cathode of said electronic separator comprises a first plate and a plurality of pipes connected to said plate, said pipes including open ends having knife-shaped edges, and said anode comprises a second plate disposed in parallel relation to said first plate, said second plate including circular bores therethrough generally concentric with said pipes.

5. A device in accordance with claim 1, comprising an adjustable resistor connected in series with said diode.

6. A device in accordance with claim 1, comprising a periodically chargeable and dischargeable load capacitor connected in circuit with and periodically charged and discharged through said primary winding.

7. A device in accordance with claim 6, comprising a further diode connected in circuit with said load capacitor and a thyristor connected in series with said load capacitor and said primary winding and utilized as a discharge gate.

8. A device in accordance with claim 1, wherein said cathode comprises electrodes generally parallel to each other in a first plane and having knife-shaped edges, and said anode comprises rod-shaped members located in a second plane which is generally parallel to said first plane with said knife-shaped edges of said cathode electrodes are in a symmetrical plane between two adjacent anode electrodes.

9. A device in accordance with claim 8, wherein said separator comprises an additional anode and said device comprises means for applying a voltage to said additional anode higher than the voltage applied to the first-mentioned anode, said additional anode including means defining holes therein for the passage of air therethrough, said additional anode disposed behind the first-mentioned anode with respect to said cathode for absorbing ions.

10. A device in accordance with claim 9, comprising an air shaft with said cathode, said anode and said additional anode therein, said additional anode completely occupying the total cross-sectional area of said air shaft.

11. A device in accordance with claim 10, wherein said air shaft comprises interior walls of highly insulating plastic material.

12. A device in accordance with claim 8, wherein said cathode electrodes include point-shaped ends facing the bores in said anode plate.

13. A device in accordance with claim 12, wherein said edges are flared to form a toothed rim.

14. A device in accordance with claim 13, comprising a layer of plastic material carried on the side of said anode which faces said cathode electrodes.

15. A device in accordance with claim 12, wherein said means defining said holes in said additional anode includes oblique walls to prevent air flowing in a straight-line path therethrough.

16. A device in accordance with claim 15, wherein said additional anode comprises two parallel wire gratings and a steel wool filling between said gratings.

17. A device in accordance with claim 15, wherein said additional anode comprises individual parallel metal strips disposed in a partially overlapping louver-type arrangement.

18. A device in accordance with claim 8, wherein said anode comprises an angular section having equal length legs with the insides of said legs symmetrically facing two adjacent ones of said cathode electrodes.

19. A device in accordance with claim 18, comprising insulating means including an insulating strip interconnecting the ends of said legs.

20. A device in accordance with claim 19, wherein said strip comprises a plastic material.

21. A device in accordance with claim 19, wherein said strip comprises a glass fiber reinforced polyester material.

22. A device in accordance with claim 19, comprising a metal layer carried on said strip on the side thereof facing said cathode.

23. A device in accordance with claim 22, comprising two supplementary electrodes disposed on either side of each of said cathode electrodes, said supplementary electrodes electrically connected to said cathode electrodes and arranged parallel to said knife-shaped edges thereof, said supplementary electrodes including edges having a substantially larger radius of curvature than said knife-shaped edges.

24. A device in accordance with claim 23, comprising a fan disposed at the side of said cathode facing away from said anode.

25. A device in accordance with claim 23, comprising a fan providing an air velocity of approximately double the ion migration speed disposed at the side of said cathode facing away from said anode.

26. A device in accordance with claim 25, wherein said supplementary electrodes are interconnected therebetween to provide air passage therethrough only in the vicinity of said knife-shaped cathode electrodes.

* * * * *